US006557740B1

(12) United States Patent
Dent

(10) Patent No.: US 6,557,740 B1
(45) Date of Patent: May 6, 2003

(54) DEVICE FOR REMOVING A PILL FROM ITS PACKAGE

(76) Inventor: Sue Dent, 11383 N. 12000 E. Rd., Grant Park, IL (US) 60940

( * ) Notice: Subject to any disclaimer, the term of this patent is extended or adjusted under 35 U.S.C. 154(b) by 127 days.

(21) Appl. No.: 09/659,722

(22) Filed: Sep. 8, 2000

(51) Int. Cl.[7] ..... B65B 69/00; B26F 1/00; G07F 11/66

(52) U.S. Cl. ..... 225/104; 225/96; 414/412; 53/381.2; 222/82; 30/124; 30/363; 30/128; 30/229; 221/26; 221/31; 206/532

(58) Field of Search ..... 83/682, 946, 945, 83/932, 866, 861, 879, 167, 150, 153, 566, 569, 605; 30/124, 2, 1, 363, 278, 289, 358, 123, 128, 131, 134, 229, 230, 178, 359, 367; 206/538, 532, 531; 221/25, 26, 31, 32, 74, 27; 53/381.2; 414/412; 225/103, 104, 96; 222/81, 82, 95, 325, 541.3

(56) References Cited

U.S. PATENT DOCUMENTS 3,196,728 A * 7/1965 Snow ..... 83/682
4,169,531 A * 10/1979 Wood ..... 206/531
4,384,649 A * 5/1983 Brodsky ..... 206/531
4,428,709 A * 1/1984 Peters ..... 83/689
4,690,676 A * 9/1987 Moulding et al. ..... 206/538
4,781,696 A * 11/1988 Moulding et al. ..... 604/189
5,431,283 A * 7/1995 Weinstein et al. ..... 604/189
5,630,347 A * 5/1997 Elvio ..... 206/531
5,740,717 A * 4/1998 Sowden et al. ..... 83/210
5,853,101 A * 12/1998 Weinstein ..... 83/879
5,909,822 A * 6/1999 George et al. ..... 220/284
5,974,929 A * 11/1999 Kugel et al. ..... 83/582
5,988,429 A * 11/1999 Coe ..... 221/25
6,155,424 A * 12/2000 Dubach ..... 221/25
6,206,233 B1 * 3/2001 Schulze ..... 206/531
6,338,408 B1 * 1/2002 Anderson ..... 206/538

* cited by examiner

*Primary Examiner*—Boyer D. Ashley
(74) *Attorney, Agent, or Firm*—Goldstein & Lavas, P.C.

(57) ABSTRACT

A device for removing a pill from its package including a lower base portion having a generally rectangular configuration. The lower base portion has a top wall, a bottom wall, a front wall, a back wall, and opposed side walls. The front wall has an upper arm and a lower arm extending outwardly therefrom whereby the upper arm is contiguous with the top wall and the lower arm is contiguous with the bottom wall. The upper arm has an aperture therethrough. An upper arm portion is hingedly coupled with the lower base portion. The upper arm portion is comprised of an elongated central section, a downwardly turned back portion, and a forward head portion. The forward head portion has a downwardly extending protrusion secured thereto. The protrusion is aligned with the aperture in the upper arm of the lower base portion.

6 Claims, 2 Drawing Sheets

DEVICE FOR REMOVING A PILL FROM ITS PACKAGE

BACKGROUND OF THE INVENTION

The present invention relates to a device for removing a pill from it's package and more particularly pertains to allowing a pill to be easily removed from a standard punch card package.

The use of pill dispensing devices is known in the prior art. More specifically, pill dispensing devices heretofore devised and utilized for the purpose of dispensing pills from a package are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,019,125 to Rebne discloses a dispensing container for pill cartridges with a flexible material at the top and a tear away section at the bottom and a device comprised of a hinged panel member capable of forcing the medicine out of the cartridge. U.S. Pat. No. 2,943,730 to Tregilas discloses a pill dispenser device.

While these devices fulfill their respective, particular objective and requirements, the aforementioned patents do not describe a device for removing a pill from it's package for allowing a pill to be easily removed from a standard punch card package.

In this respect, the device for removing a pill from it's package according to the present invention substantially departs from the conventional concepts and designs of the prior art, and in doing so provides an apparatus primarily developed for the purpose of allowing a pill to be easily removed from a standard punch card package.

Therefore, it can be appreciated that there exists a continuing need for a new and improved device for removing a pill from it's package which can be used for allowing a pill to be easily removed from a standard punch card package. In this regard, the present invention substantially fulfills this need.

SUMMARY OF THE INVENTION

In the view of the foregoing disadvantages inherent in the known types of pill dispensing devices now present in the prior art, the present invention provides an improved device for removing a pill from it's package. As such, the general purpose of the present invention, which will be described subsequently in greater detail, is to provide a new and improved device for removing a pill from it's package which has all the advantages of the prior art and none of the disadvantages.

To attain this, the present invention essentially comprises a lower base portion having a generally rectangular a configuration. The lower base portion has a top wall, a bottom wall, a front wall, a back wall, and opposed side walls. The front wall has an upper arm and a lower arm extending outwardly therefrom whereby the upper arm is contiguous with the top wall and the lower arm is contiguous with the bottom wall. The upper arm has an aperture therethrough. The upper arm has a cutting blade extending upwardly therefrom inwardly of the aperture. The lower arm has an arcuate recess extending inwardly thereof. The top wall has an opening therein adjacent to the back wall. An upper arm portion is hingedly coupled with the lower base portion. The upper arm portion is comprised of an elongated central section, a downwardly turned back portion, and a forward head portion. The downwardly turned back portion is received within the opening in the top wall of the lower base portion and coupled thereto by a spring-biased hinge pin. The forward head portion has a downwardly extending protrusion secured thereto. The protrusion is aligned with the aperture in the upper arm of the lower base portion. The forward head portion has a recess extending upwardly therein. The recess is aligned with the cutting blade of the lower base portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved device for removing a pill from it's package which has all the advantages of the prior art pill dispensing devices and none of the disadvantages.

It is another object of the present invention to provide a new and improved device for removing a pill from it's package which may be easily and efficiently manufactured and marketed.

It is a further object of the present invention to provide a new and improved device for removing a pill from it's package which is of durable and reliable construction.

An even further object of the present invention is to provide a new and improved device for removing a pill from it's package which is susceptible of a low cost of manufacture with regard to both materials and labor, and which accordingly is then susceptible of low prices of sale to the consuming public, thereby making such a device for removing a pill from it's package economically available to the buying public.

Even still another object of the present invention is to provide a new and improved device for removing a pill from it's package for allowing a pill to be easily removed from a standard punch card package.

Lastly, it is an object of the present invention to provide a new and improved device for removing a pill from it's package including a lower base portion having a generally rectangular configuration. The lower base portion has a top wall, a bottom wall, a front wall, a back wall, and opposed side walls. The front wall has an upper arm and a lower arm extending outwardly therefrom whereby the upper arm is contiguous with the top wall and the lower arm is contiguous with the bottom wall. The upper arm has an aperture therethrough. An upper arm portion is hingedly coupled with the lower base portion. The upper arm portion is comprised of an elongated central section, a downwardly turned back portion, and a forward head portion. The forward head portion has a downwardly extending protrusion secured thereto. The protrusion is aligned with the aperture in the upper arm of the lower base portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
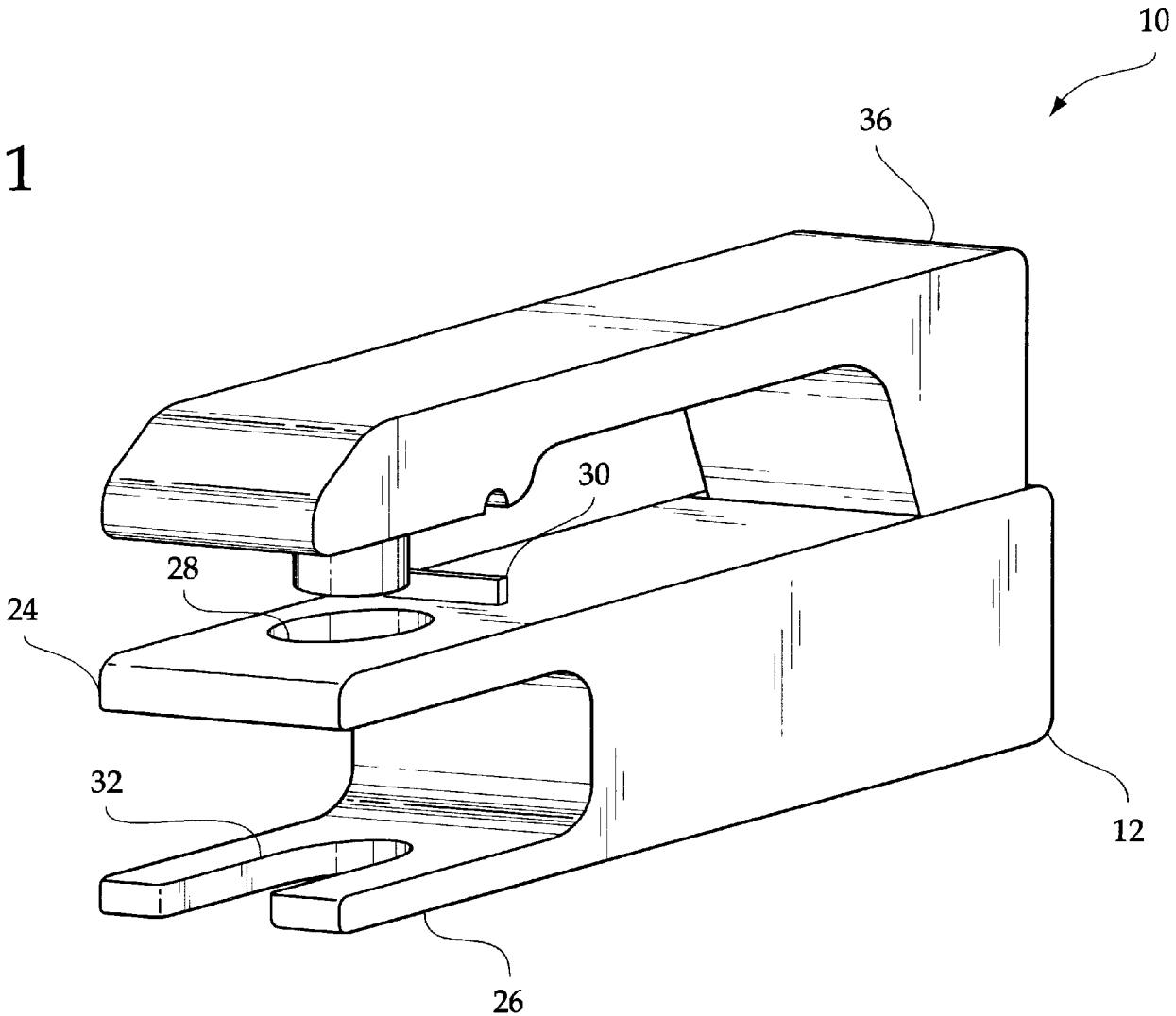
FIG. 1 is a perspective view of the preferred embodiment of the device for removing a pill from it's package constructed in accordance with the principles of the present invention.
Figure 2:
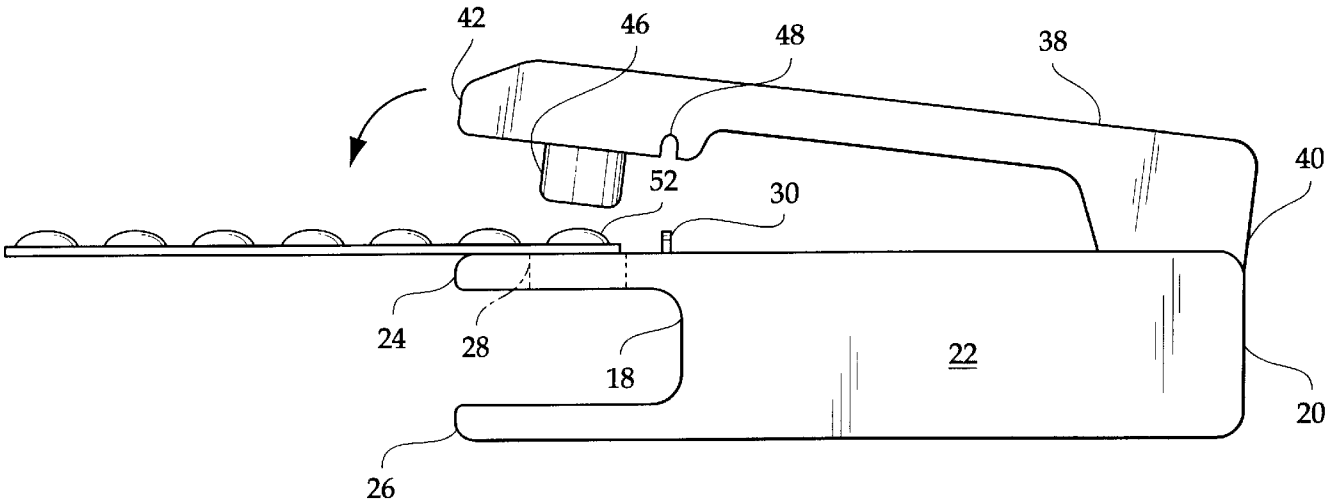
FIG. 2 is a side view of the present invention illustrated in preparation for use.
Figure 3:
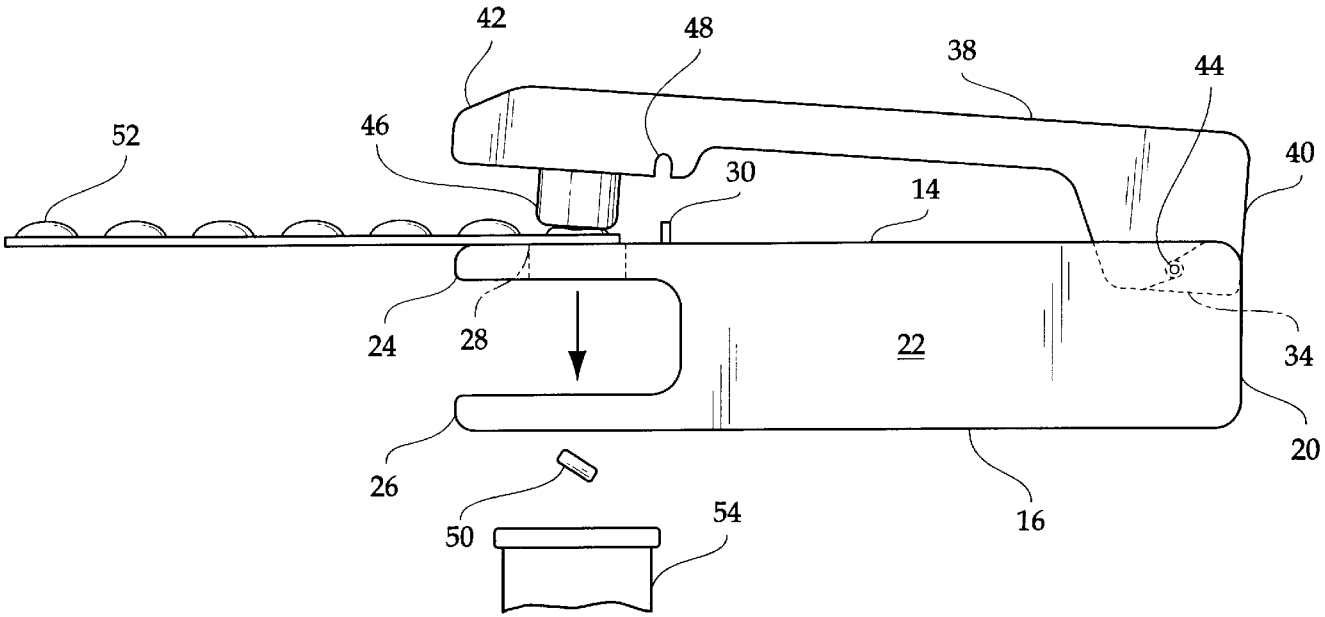
FIG. 3 is a side view of the present invention illustrated in use.

With reference now to the drawings, and in particular, to FIGS. 1 through 3 thereof, the preferred embodiment of the new and improved device for removing a pill from it's package embodying the principles and concepts of the present invention and generally designated by the reference number 10 will be described.

Specifically, it will be noted in the various figures that the device relates to a device for removing a pill from it's package which allows a pill to be easily removed from a standard punch card package. In its broadest context, the device consists of a lower base portion and an upper arm portion. Such components are individually configured and correlated with respect to each other, so as to attain the desired objective.

"The lower base portion 12 has a generally rectangular configuration. The lower base portion 12 has a top wall 14, a bottom wall 16, a front wall 18, a back wall 20, and opposed side walls 22. The front wall 18 has an upper arm 24 and a lower arm 26 extending outwardly therefrom whereby the upper arm 24 is contiguous with the top wall 14 and the lower arm 26 is contiguous with the bottom wall 16. The upper arm 24 has an aperture 28 therethrough. The upper arm 24 has a cutting blade 30 rigidly fixed to the upper arm, extending and oriented upwardly from the upper arm adjacent to the aperture 28. The lower arm 26 has an arcuate recess 32 extending toward the front wall and located immediately below the aperture. The top wall 14 has an opening 34 therein adjacent to the back wall 20.

The upper arm portion 36 is hingedly coupled with the lower base portion 12. The upper arm portion 36 is comprised of an elongated central section 38, a downwardly turned back portion 40, and a forward head portion 42. The downwardly turned back 40 portion is received within the opening 34 in the top wall 14 of the lower base portion 12 and is coupled thereto by a spring-biased hinge pin 44. The forward head portion 42 has a downwardly extending protrusion 46 fixed thereto. The protrusion 46 is aligned with the aperture 28 in the upper arm 24 of the lower base portion 12 and is capable of extending downward into the aperture, even beyond the position indicated in FIG. 3, by pivoting the upper arm portion 36 downward about the hinge pin 44. The forward head portion 42 has a recess 48 extending upwardly therein. The recess 48 is aligned with the cutting blade 30 of the lower base portion 12."

The present invention is primarily designed for removing pills 50 from their respective pouch-like packages 52 without having to resort to steps that result from the frustrating task of removing the pills 50 with one's hands alone. The user will begin by piercing the foil that is normally the only openable portion of the package 52. This piercing is accomplished using the cutting blade 30. Next, the package 52 is placed on the upper arm 24 with the pill 50 positioned over the aperture 28. The user then presses downwardly on the forward head portion 42 so that the protrusion 46 will contact the package 52 to force the pill 50 out through the cut foil and out through the aperture 28. The user can catch the pill 50 in their hand or can place a storage receptacle 54 under the lower arm 26 with it's opening under the recess 32 to receive the dispensed pill 50 therein for later use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device for removing a pill from its package which allows a pill to be easily removed from a standard punch card package comprising, in combination:

a lower base portion having a generally rectangular configuration, the lower base portion having a top wall, a bottom wall, a front wall, a back wall, and opposed side walls, the front wall having an upper arm and a lower arm extending outwardly therefrom whereby the upper arm is contiguous with the top wall and the lower arm is contiguous with the bottom wall, the upper arm having an aperture therethrough, the upper arm having a cutting blade rigidly attached thereto, the cutting blade extending and oriented upwardly therefrom adjacent to the aperture, the lower arm having an arcuate recess extending toward the front wall such that the arcuate recess extends immediately below the aperture, the top wall having an opening; and an upper arm portion hingedly coupled with the lower base portion, the upper arm portion being comprised of an elongated central section, a downwardly turned back portion, and a forward head portion, the downwardly turned back portion being received within the opening in the top wall of the lower base portion and coupled to the lower base by a spring-biased hinge pin, the forward head portion having a downwardly extending protrusion fixed thereto, the protrusion being aligned with the aperture in the upper arm of the lower base portion, the protrusion capable of extending downward into the aperture, the forward head portion having a recess extending upwardly therein, the recess being aligned with the cutting blade of the lower base portion.

2. The device for removing a pill from its package as set forth in claim 1, wherein the forward head portion of the upper arm portion has a recess extending upwardly therein, the recess being aligned with the cutting blade of the lower base portion.

3. A device for removing a pill from it's package which allows a pill to be easily removed from a standard punch card package comprising, in combination:

a lower base portion having a generally rectangular configuration, the lower base portion having a top wall, a bottom wall, a front wall, a back wall, and opposed side walls, the front wall having an upper arm and a lower arm extending outwardly therefrom, the upper arm and lower arm in fixed positions relative to each other, whereby the upper arm is contiguous with the top wall and the lower arm is contiguous with the bottom wall, the upper arm having an aperture therethrough; and an upper arm portion hingedly coupled with the lower base portion, the upper arm portion being comprised of an elongated central section, a downwardly turned back portion, and a forward head portion, the forward head portion having a downwardly extending protrusion fixed thereto, the protrusion being aligned with the aperture in the upper arm of the lower base portion, the protrusion capable of extending downward into the aperture, and wherein the upper arm of the lower base portion has a cutting blade rigidly attached thereto, extending and oriented upwardly therefrom immediately adjacent to the aperture.

4. The device for removing a pill from its package as set forth in claim 3, wherein the lower arm of the lower base portion has an arcuate recess extending toward the front wall of the lower base.

5. The device for removing a pill from its package as set forth in claim 3, wherein the top wall of the lower base portion has an opening therein adjacent to the back wall for receiving the downwardly turned back portion of the upper arm portion in said opening.

6. The device for removing a pill from its package as set forth in claim 5, wherein the downwardly turned back portion is coupled with the lower base portion by a spring-biased hinge pin.

* * * * *